US010979821B2

(12) United States Patent
Xiao et al.

(10) Patent No.: US 10,979,821 B2
(45) Date of Patent: Apr. 13, 2021

(54) SOUND GENERATOR

(71) Applicant: AAC Technologies Pte. Ltd., Singapore (SG)

(72) Inventors: Bo Xiao, Shenzhen (CN); Ronglin Linghu, Shenzhen (CN); Xiaodong Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/711,384

(22) Filed: Dec. 11, 2019

(65) Prior Publication Data

US 2020/0213765 A1 Jul. 2, 2020

(30) Foreign Application Priority Data

Dec. 30, 2018 (CN) ..... 201822275868.9

(51) Int. Cl.

| | |
|---|---|
| ***H04R 7/00*** | (2006.01) |
| ***H04R 9/00*** | (2006.01) |
| ***H04R 9/06*** | (2006.01) |
| ***H04R 7/12*** | (2006.01) |
| ***H04R 9/02*** | (2006.01) |
| ***H04R 7/18*** | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 2400/11* (2013.01)

(58) Field of Classification Search

CPC ... H04R 7/00; H04R 7/04; H04R 7/12; H04R 7/122; H04R 7/127; H04R 7/18; H04R 9/00; H04R 9/02; H04R 9/025; H04R 9/04; H04R 9/045; H04R 9/046; H04R 9/06; H04R 9/063; H04R 2209/041; H04R 2209/026; H04R 2400/11

See application file for complete search history.

(56) References Cited

U.S. PATENT DOCUMENTS

| | | | | |
|---|---|---|---|---|
| 2014/0169593 | A1* | 6/2014 | Kwon | H04R 9/043 381/185 |
| 2014/0241566 | A1* | 8/2014 | Choi | H04R 9/043 381/400 |
| 2018/0332397 | A1* | 11/2018 | Kim | H04R 9/045 |
| 2020/0045433 | A1* | 2/2020 | Hu | H04R 9/043 |
| 2020/0045453 | A1* | 2/2020 | Xiao | H04R 9/046 |

FOREIGN PATENT DOCUMENTS

| | | | |
|---|---|---|---|
| CN | 109379681 A | * | 2/2019 |
| CN | 109862487 A | * | 6/2019 |

* cited by examiner

*Primary Examiner* — Thang V Tran
(74) *Attorney, Agent, or Firm* — W&G Law Group LLP

(57) ABSTRACT

An embodiment of the present invention provides a sound generator having a frame; a magnetic circuit system fixed to the frame, and a vibration system. The magnetic circuit system includes a main magnet and an auxiliary magnet surrounding the main magnetic. The vibration system includes a vibrating diaphragm having a first vibrating diaphragm, a second vibrating diaphragm, and a dome for connecting the first vibrating diaphragm to the second vibrating diaphragm. A gap is formed between the auxiliary magnet and the frame. The dome has a body part, two first extension parts, and two second extension parts. The first extension part is located within the gap. Accordingly, the sound generator can solve the swing problem, and improve the low frequency performance.

9 Claims, 5 Drawing Sheets

A-A

SOUND GENERATOR

FIELD OF THE PRESENT DISCLOSURE

The present invention relates to the field of electroacoustic transducers, and more specifically, to a sound generator for converting electrical signals into sounds.

DESCRIPTION OF RELATED ART

With the arrival of mobile internet era, the number of intelligent mobile devices is on the increase. While among so many mobile devices, mobile phone is undoubtedly the most common and portable mobile terminal device. Currently, mobile phone has a great variety of functions including but not limited to high-quality music function, and a sound generator, also named speaker, in the mobile phone is one of the necessary conditions for achieving such high-quality music function. As a voice playing device, sound generator has its voice quality directly dependant on its structure design.

The sound generator of related art comprises a membrane and a voice coil driving the membrane to vibrate and sound. Common mini-type sound generators are mostly of single-membrane design, the voice coil tends to swing during vibration under force so as to influence the mobile stability of the vibration system and thus the sound quality.

Therefore, it is necessary to provide a new sound generator to solve the problem above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
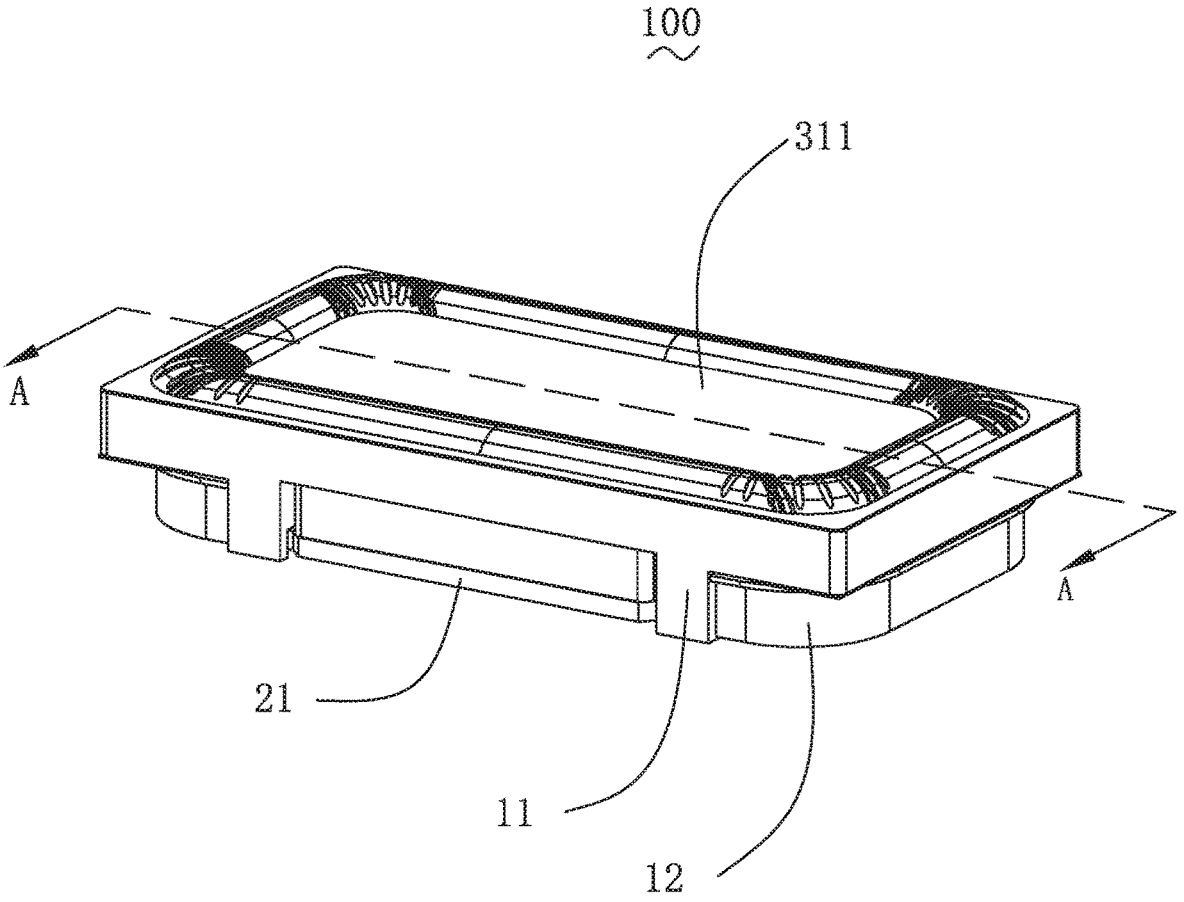
FIG. 1 is an isometric view of a sound generator in accordance with an exemplary embodiment of the present invention.
Figure 2:
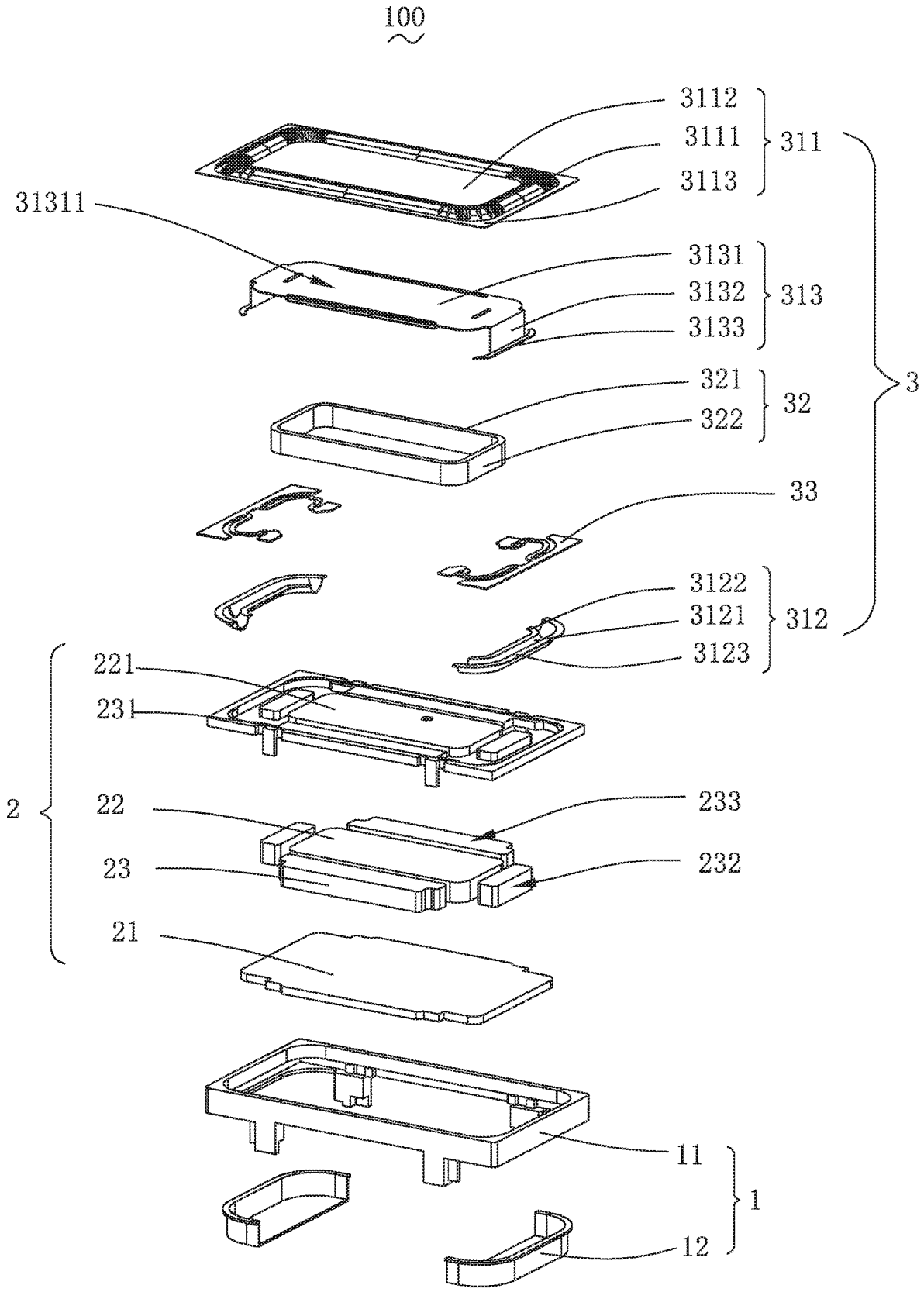
FIG. 2 is an isometric and exploded view of the sound generator of the embodiment.
Figure 4:
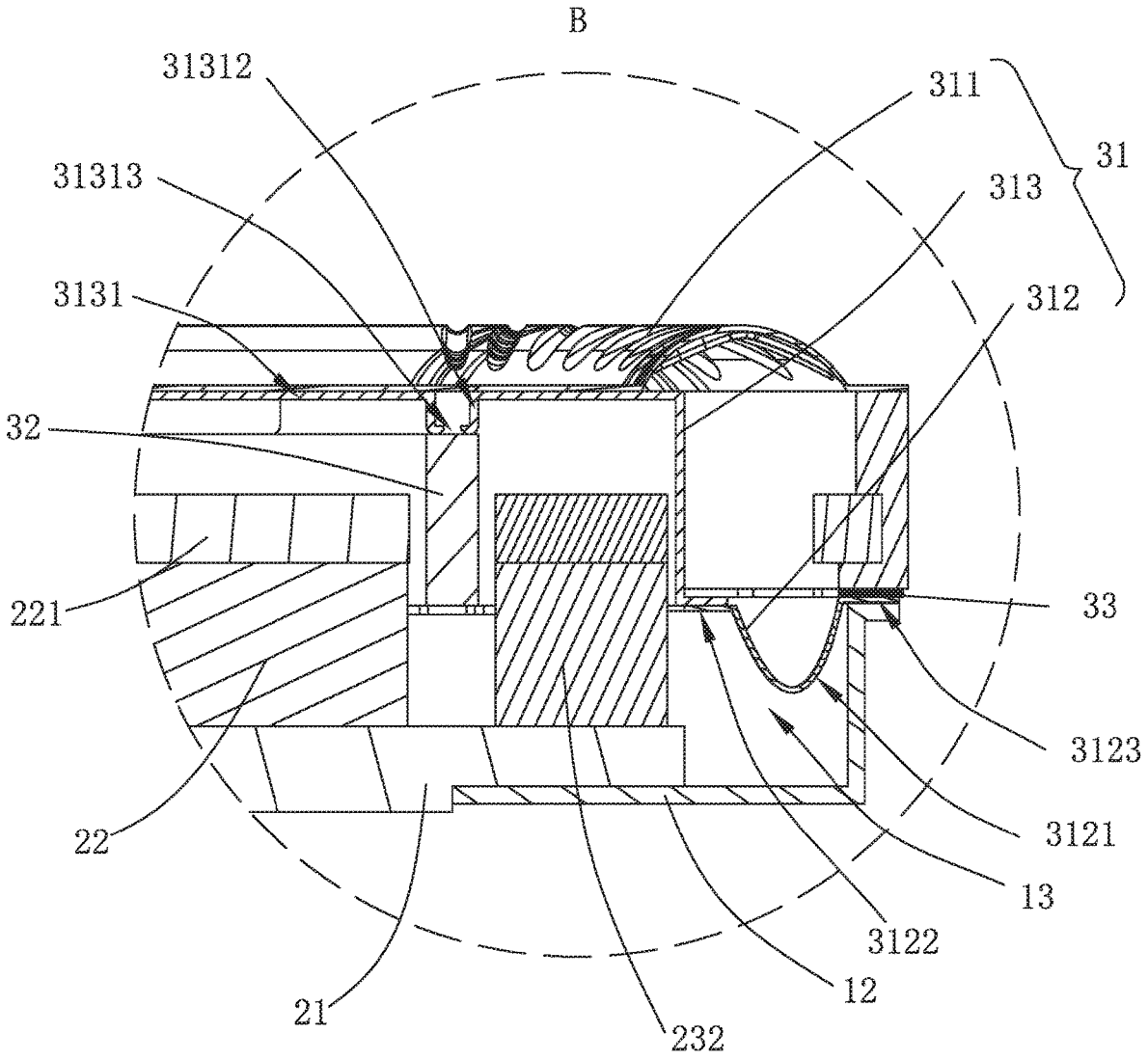
FIG. 4 is an enlarged view of Part B in FIG. 3.

With reference to FIGS. 1, 2 and 4, the present invention provides a sound generator 100 which comprises a frame 1, a magnetic circuit system 2 fixed to the frame 1 and a vibration system 3.

The magnetic circuit system 2 comprises a magnetic yoke 21, a main magnet 22 fixed to the magnetic yoke 21, an auxiliary magnet 23 provided surrounding the main magnet 22, and a main pole core 221 and an auxiliary pole core 231 attached to the main magnet 22 and the auxiliary magnet 23 respectively.

Wherein, the auxiliary magnet 23 can be a integrated piece of annular magnet, or multiple bar-shaped magnets provided surrounding the main magnet 22. In this embodiment, four auxiliary magnets 23 are provided in total, which are bar-shaped magnets surrounding the main magnet 22 and provided symmetrically along the center.

The main pole core 221 and the auxiliary pole core 231 are made of magnetic conductive material for magnetic induction, magnetic field convergence to improve the magnetic inductive capacity of the products, the auxiliary pole core 231 can be an annular pole core or bar-shaped pole core. In this embodiment, the auxiliary pole core 231 comprises two bar-shaped pole cores and an annular pole core and attached on the four auxiliary magnets 23 respectively.

The frame 1 comprises a main frame 11 and an auxiliary frame 12 connecting the main frame 1 and the magnetic yoke 21.

The vibration system 3 comprises a vibrating diaphragm 31 and a voice coil 32 driving the vibrating diaphragm 31 to vibrate. The vibrating diaphragm 31 comprises a first vibrating diaphragm 311 and a second vibrating diaphragm 312 provided spaced apart and opposite to each other.

The first vibrating diaphragm 311 comprises a first suspension part 3111, a first middle part 3112 provided at the inner side of the first suspension part 3111 and a first fixation part 3113 provided at the outer side of the first suspension part 3111. The second vibrating diaphragm 312 comprises a second suspension part 3121, a second middle part 3122 provided at the inner side of the second suspension part 3121 and a second fixation part 3123 provided at the outer side of the second suspension part 3121.

The voice coil 32 has a cross section in a rectangular shape comprising two long edges 321 and two short edges 322.

Figure 3:
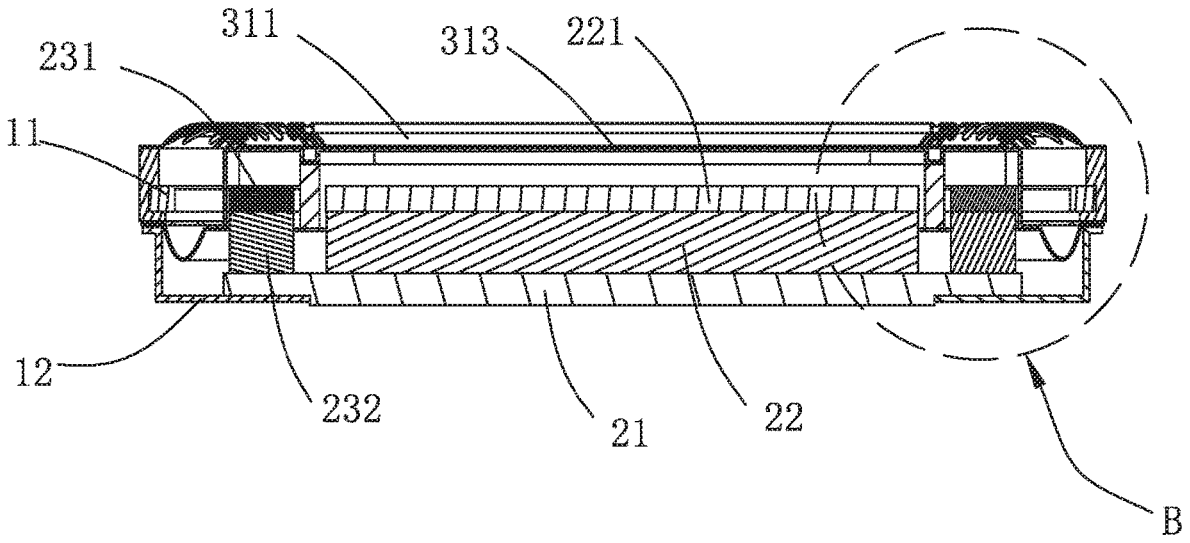
FIG. 3 is a cross-sectional view of the sound generator taken along line A-A in FIG. 1.

With reference to FIGS. 2-4, the vibrating diaphragm 31 also comprises a dome 313, the dome 313 comprises a body part 3131 fixed to the first vibrating diaphragm 311, two first extension parts 3132 extending towards the direction close to the second vibrating diaphragm 312 from the two opposite ends of the body part 3131 and two second extension parts 3133 bending and extending from the ends of the two first extension parts 3132 and connecting with the second vibrating diaphragm 312. Preferably, the two second extension parts 3133 are fixed with the two first extension parts 3132 respectively; preferably, the first extension part 3132 is provided to form a right angle with both the body part 3131 and the second extension part 3133.

The dome 313 connects the first diaphragm 311 and the second diaphragm 312. Specifically, the body part 3131 is fixedly connected at one side of the first middle part 3112 facing the voice coil. The second extension part 3133 has a shape matching the shape of the second middle part 3122, and the second extension part 3133 is adhesively fixed at the side of the second middle part 3122 facing the first vibrating diaphragm 311. Furthermore, the auxiliary magnet 23 comprises a first auxiliary magnet 232 close to the short side 322 and a second auxiliary magnet 233 close to the long side 321, with a first gap 13 formed between the first auxiliary magnet 232 and the frame 1, the first extension part 3132 is located within the first gap 13.

The body part 3131 comprises a first surface 31311 fixedly connected with the vibrating diaphragm 31. The dome 313 further comprises abutting parts 31312 concave and extending towards the direction close to the voice coil 32 from the first surface 31311 to abut the voice coil 32. Preferably, four abutting parts 31312 are provided correspondingly at the two long edges 321 and the two short edges 322 and abutting the two long edges 321 and two short edges 322 respectively.

Besides, in this embodiment, the abutting part 31312 has a through hole 31313 provided at the bottom, by filling glue into the abutting part 31312, the dome 311 can be adhesively fixed with the voice coil 21.

Figure 5:
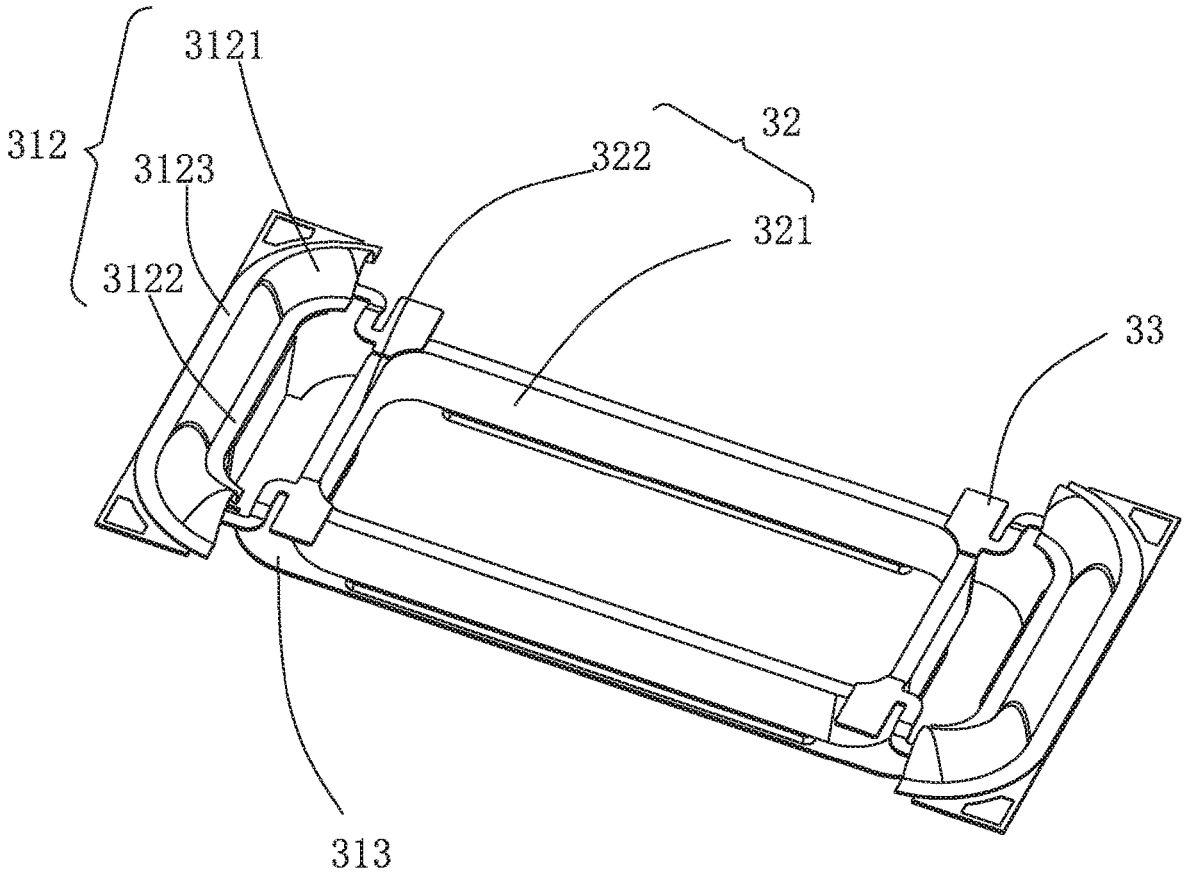
FIG. 5 is an assembled view of a dome, a voice coil, a centering supporting piece and a second vibrating diaphragm of the sound generator of the embodiment.

With reference to FIGS. 3 and 5, the vibration system 3 further comprises a center fixed supporting flake 33 with one end thereof fixed to one end of the voice coil 32 far away from one end of the first vibrating diaphragm 311, and another end fixed to the frame 1. The second fixation part 3123 is fixedly fitted at one side of the center fixed supporting flake 33 far away from the voice coil 32. Specifically, the center fixed supporting flake 33 is fixed with the short side 322, the second fixation part 3123 and the center fixed supporting flake 33 are switched between the main frame 11 and the auxiliary frame 12.

Compared to related art, in the sound generator provided by the present invention, the body part of the dome is fixedly connected with the first vibrating diaphragm, the partial section of the dome is folded with the first extension part inserted into the gap between the auxiliary magnet and the frame, the second extension part of the dome is adhesively fixed with the second vibrating diaphragm, finally, the dome connects the first vibrating diaphragm and the second vibrating diaphragm, forming a joint vibration unit of the first, second vibrating diaphragms, such vibration unit can improve the swing of the sound generator, and improve the low frequency performance of the sound generator.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator comprising:

a frame;

a magnetic circuit system fixed to the frame, comprising a main magnet and an auxiliary magnet surrounding the main magnet;

a gap formed between the auxiliary magnet and the frame;

a vibration system including a vibrating diaphragm having a first vibrating diaphragm, a second vibrating diaphragm, and a dome for connecting the first vibrating diaphragm to the second vibrating diaphragm; and a voice coil for driving the vibrating diaphragm to vibrate;

wherein the dome comprises a body part fixed to the first vibrating diaphragm, two first extension parts formed by extending toward the second vibrating diaphragm from two opposite ends of the body part respectively, and two second extension parts bending and extending from two ends of the first extension parts and fixed with the second vibrating diaphragm; and the first extension part is located within the gap.

2. The sound generator as described in claim 1, wherein the body part comprises a first surface fixed to the vibrating diaphragm, the dome further comprises an abutting part concave and extending from the first surface to the voice coil.

3. The sound generator as described in claim 2, wherein the voice coil has a cross section in a rectangular shape comprising two long edges and two short edges, four abutting parts are provided correspondingly abutting against the two long edges and two short edges respectively.

4. The sound generator as described in claim 3, wherein the abutting part has a through hole in a bottom thereof.

5. The sound generator as described in claim 1, wherein the first vibrating diaphragm comprises a first suspension part, a first middle part provided at the inner side of the first suspension part, and a first fixation part provided at the outer side of the first suspension part, the body part is fixedly connected at one side of the first middle part facing the voice coil.

6. The sound generator as described in claim 3, wherein the second vibrating diaphragm comprises a second suspension part, a second middle part provided at an inner side of the first suspension part, and a second fixation part provided at an outer side of the second suspension part; the second extension part has a shape matching the shape of the second middle part, and the second extension part is adhesively fixed with one side of the second middle part facing the first vibrating diaphragm.

7. The sound generator as described in claim 6, wherein the vibration system further comprises a center fixed supporting flake with one end thereof fixed to one end of the voice coil far away from one end of the first vibrating diaphragm, and another end thereof fixed to the frame; the second fixation part is attached at one side of the center fixed supporting flake far away from the voice coil.

8. The sound generator as described in claim 7, wherein the auxiliary magnet comprises a first auxiliary magnet close to the short side, a second auxiliary magnet close to the long side, and a first gap formed between the first auxiliary magnet and the frame; and the first extension part is located within the first gap.

9. The sound generator as described in claim 1, wherein the first extension part forms a right angle with both the body part and the second extension part.

* * * * *